US005158102A

United States Patent [19]

Lemcke

[11] Patent Number: 5,158,102

[45] Date of Patent: Oct. 27, 1992

[54] UMBRELLA FRAME HAVING FOLDING EAR STRUCTURES

[75] Inventor: Harland F. Lemcke, Corona, Calif.

[73] Assignee: McCampbell Enterprises Unlimited, Inc., Fort Wayne, Ind.

[21] Appl. No.: 844,153

[22] Filed: Mar. 2, 1992

[51] Int. Cl.[5] ..... A45B 3/00

[52] U.S. Cl. ..... 135/46; 135/33.2; 135/26

[58] Field of Search ..... 135/33.2, 15.1, 16, 135/25 R, 26, 29, 31, 27

[56] References Cited

U.S. PATENT DOCUMENTS

| | | | |
|---|---|---|---|
| 74,944 | 2/1868 | Schreiner | 135/33.2 |
| 1,310,399 | 7/1919 | Levin . | |
| 2,143,978 | 1/1939 | Eeles | 135/27 X |
| 2,380,175 | 10/1943 | Hawkey | 46/151 |
| 2,985,179 | 5/1961 | Givens | 135/33.2 X |
| 3,498,306 | 3/1970 | Edelking | 135/33.2 |
| 4,597,400 | 7/1986 | Trudeau, Sr. | 135/18 |
| 4,607,653 | 8/1986 | Hermanson | 135/20 M |
| 4,641,675 | 2/1987 | Wu | 135/20 A |
| 4,739,783 | 4/1988 | Yang | 135/25 |
| 4,760,610 | 8/1988 | Wu et al. | 2/180 |
| 4,838,290 | 6/1989 | Wu | 135/25 R |
| 4,880,023 | 11/1989 | Lin | 135/25 R |
| 4,884,586 | 12/1989 | Szu et al. | 135/25 A |

FOREIGN PATENT DOCUMENTS

| | | | |
|---|---|---|---|
| 0584016 | 1/1977 | Switzerland | 135/33.2 |

*Primary Examiner*—David A. Scherbel
*Assistant Examiner*—Lan Mai
*Attorney, Agent, or Firm*—Baker & Daniels

[57] ABSTRACT

An umbrella frame having two collapsibly protractable structures defining ear-like projections. The umbrella frame has a plurality of ribs and associated pivotally attached struts extendable to define a characteristic dome shaped umbrella. The struts are further attached to a runner axially slidable on a central shaft of the umbrella that causes the outward extension of the struts to push the ribs outwardly when the runner is upwardly moved. In addition, two pairs of braces are respectively pivotally attached on one end to opposing struts either at the same point or at separate locations thereon, and extend through respective guide brackets fixedly attached to respective outer ribs. The other ends of the braces extend beyond the outer dome of the umbrella and are pivotally attached to a swivel coupling that causes loop shaped bending of the braces to define outwardly projecting ears from the characteristic dome shaped umbrella when the struts are extended by upwardly moving the runner.

30 Claims, 5 Drawing Sheets

UMBRELLA FRAME HAVING FOLDING EAR STRUCTURES

BACKGROUND OF THE INVENTION

The present invention relates to umbrella frames and, more particularly, to an umbrella frame having extendable structures defining projecting ears or other shapes.

Heretofore, novelty umbrellas have been developed having extending structures defining various shapes protruding from and in addition to the characteristic dome umbrella shape. Most notably these shapes take the form of baseball caps or hats as exemplified in U.S. Pat. Nos. 4,597,400 Trudeau, Sr., 4,641,675 Wu, 4,760,610 Wu et al., 4838,290 Wu, and 4,884,586 Szu et al. In these patents, extra ribs radially outwardly project from the lower portion of the dome shaping ribs to define the bill or rim of the cap or hat.

U.S. Pat. No. 4,880,023 Lin discloses another novelty umbrella having extending structures defining ears that outwardly project from the characteristic dome umbrella shape. The umbrella includes a characteristic runner slidably surrounding the handle which, in addition to the normal strut members that are connected to and extend from the runner, include two sets of extendable looped-shaped ribs which are likewise connected to the runner. These looped-shaped ribs outwardly project beyond the characteristic dome ribs when the runner is upwardly extended to define ears. An additional brace member is also pivotally attached at one end to a dome rib and at the other end to a respective looped-shaped rib intermediate the outwardly extending portion of the ear structure. Thus, as the runner is pushed up, both the struts and the looped-shaped ribs are extended while one portion of the looped-shaped rib pivots the respective brace member to thereby define the ear structure.

It is therefore a primary object of the present invention to provide a simpler, less complex umbrella structure that defines outwardly projecting ears or similar structures when the umbrella is fully extended.

SUMMARY OF THE INVENTION

The present invention provides an umbrella frame having a collapsible protractable frame structure defining ear-like projections that extend beyond the characteristic dome structure as the umbrella is opened.

Two frames are provided pivotally connected to opposed struts which bow into ear-like projections as the umbrella frame is opened.

Loop members consisting of first and second frame segments for each ear structure are pivotally attached at one end to a strut member and respectively extend through separate guide brackets fixedly attached to an outer dome rib. The other ends of the frame segments are pivotally attached to a swivel coupling that bows the frame segments into a loop shape when the umbrella is extended.

A tubular sleeve may radially surround each frame segment extending from the strut member to approximately just below the guide bracket. The tubular sleeves provide rigidity to the frame segments and help to induce bending of the frame segments only at the outer section where the frame segments are pivotally attached to the swivel coupling so as to prevent kinking.

By pushing the umbrella runner, the struts extend the outer dome ribs and the loop members pivotally attached thereto. This upward movement presses the frame segments against the swivel coupling causing the frame segments to bow, thus forming loop shaped structures defining ears projecting from the characteristic dome shaped umbrella.

Thus, the intermediate brace is eliminated. The attachment of the entire frame to the runner is also eliminated thereby reducing the complexity of the structure and providing a simpler design.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
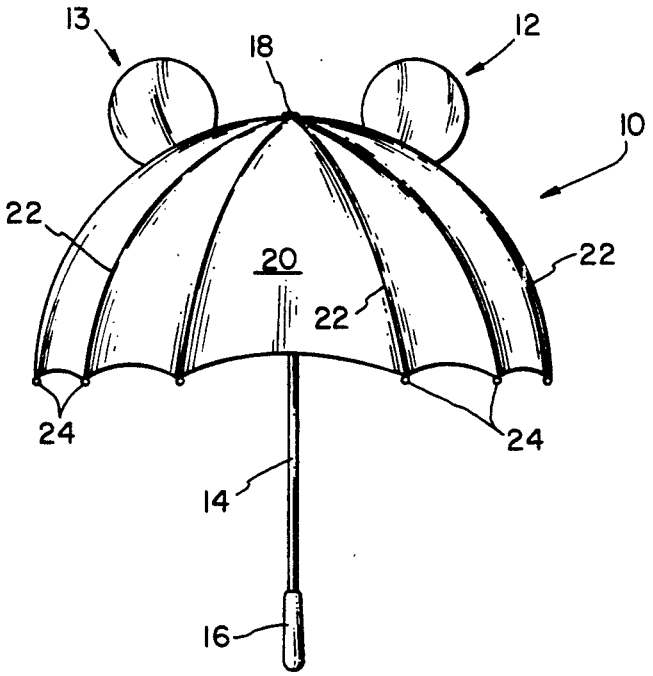
FIG. 1 is a front elevational view of the umbrella of the present invention.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Referring now to FIG. 1, there is shown an umbrella 10 having two collapsible protractable ear frame structures 12 and 13 according to the present invention. Umbrella 10 includes a central shaft 14 with a handle or grip 16 on one end, and a outwardly extend into an almost perpendicular position relative to shaft 14 which causes ribs 22 to pivot about crown 18 to outwardly extend in a bow-like fashion relative to shaft 14. Umbrella 10 stays in an open position by retaining runner 28 on a catch 34 that pivotally extends from shaft 14 thereby holding runner 28 in a predetermined place dependent on the placement of catch 34. In order to close umbrella 10, catch 34 is pushed inwardly to pivot into handle 14 thereby allowing runner 28 to freely slide axially downwardly on handle 14. Ribs 22 and struts 30 are generally fashioned from a resilient metal, but could be any material sufficiently resilient but strong enough to support the pressures exerted by the canopy when the umbrella is fully extended.

Figure 4:
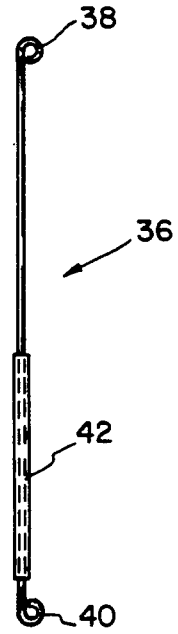
FIG. 4 is an enlarged elevational view of an unbent frame segment of FIG. 2.

Additionally referring to FIG. 4, there is shown an exemplary ear frame segment 36 having upper and lower eyelets 38 and 40 integrally formed at the ends of frame segment 36. A stiffening device 42, such as a tubular sleeve or spring fabricated from metal such as brass or from a hard plastic, or other material radially surrounds approximately the lower ⅓ of frame segment 36. Tubular sleeve 42 restricts ear segment 36 from bending along the length of the sleeve, but permits bending of the segment at all other points along the segment's length not radially surrounded by tubular sleeve 42.

Figure 2:
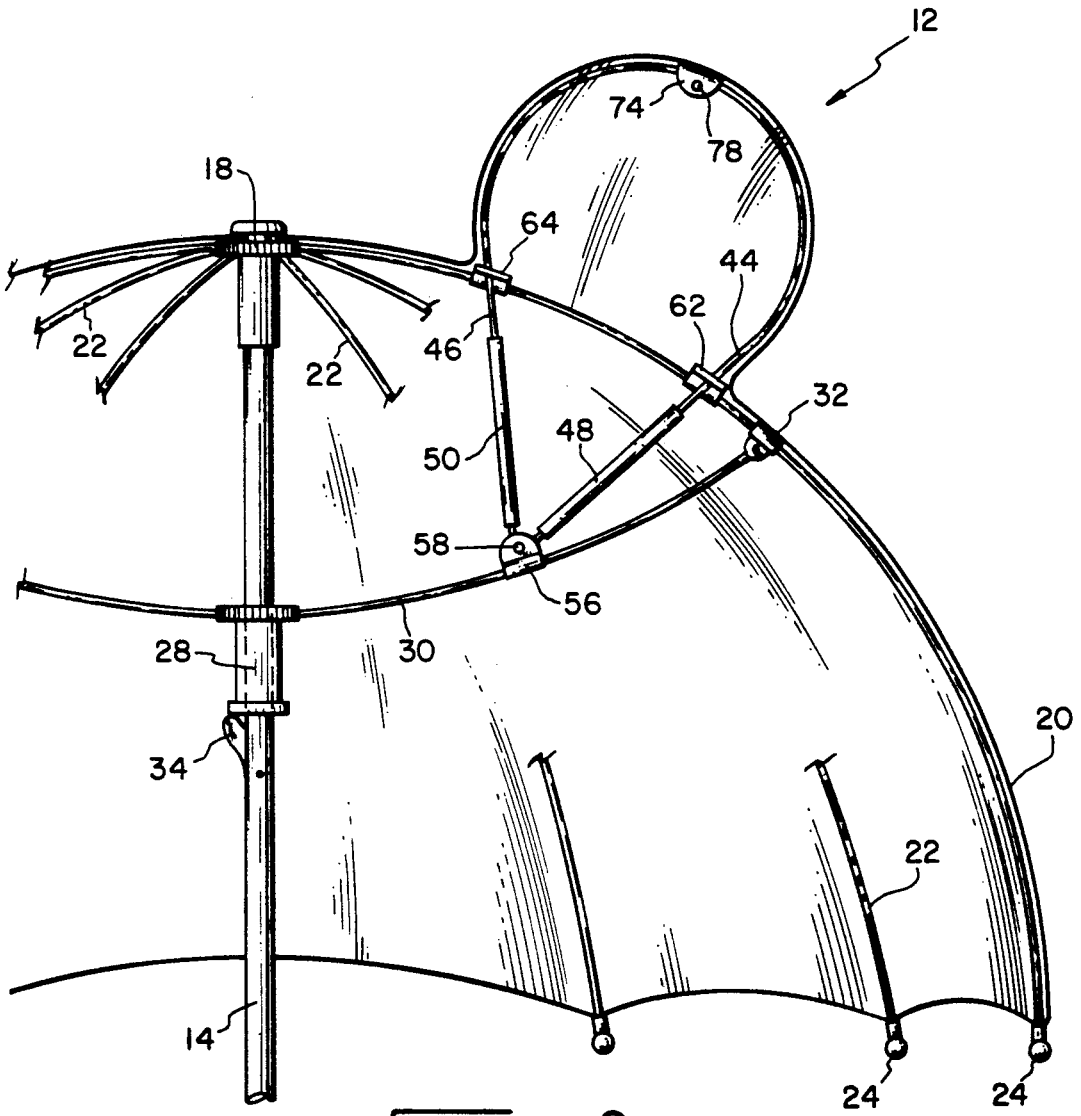
FIG. 2 is an enlarged fragmentary front cutaway view of the present umbrella showing the loop frame structure of one ear according to one embodiment thereof.
Figure 3:
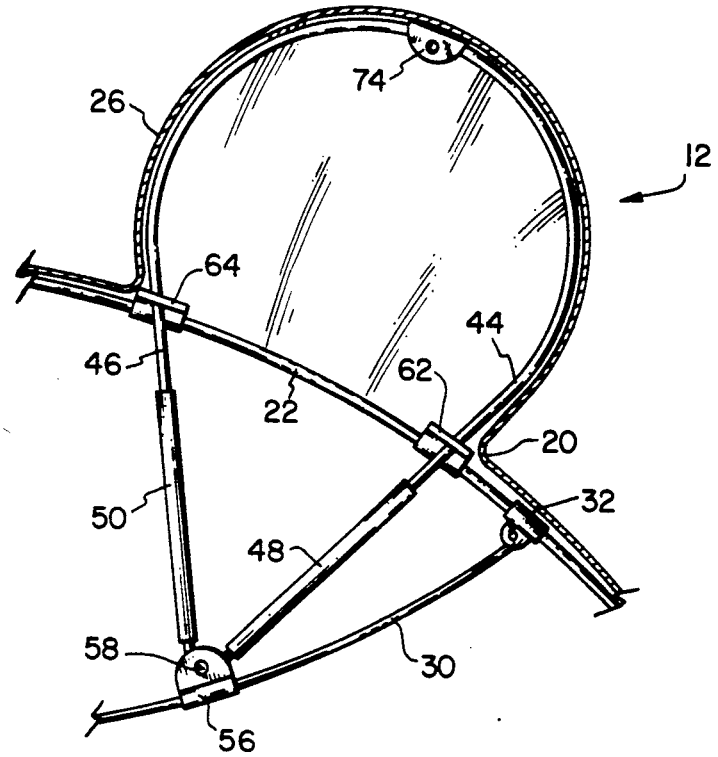
FIG. 3 is an enlarged front cutaway view of the loop frame structure of the ear of FIG. 2.

Referring back to FIG. 2 and additionally to FIG. 3, there is shown the structure of ear frame 12 according to one embodiment of the present invention. Two frame segments 44 and 46 are shown, each of which is identical to frame segment 36 shown in FIG. 4. It should be noted that each ear frame 12 and 13 is a structure having two frame segments identical to frame crown 18 on the other end. A main canopy 20 made of a suitable, preferably water-repellant cloth material is stretched over a plurality of ribs 22. Ribs 22 are radially spaced about crown 18 and pivotally extend outwardly from crown 18 in a radial pattern (see FIG. 2). Ribs 22 upwardly and downwardly pivot on crown 18 in order to expand and extend the umbrella. Disposed on each tip of ribs 22 distal crown 18 are canopy tie-offs 24 serving to receive the threads of the canopy in order to hold the canopy material stretched over the ribs. In addition, main canopy 20 includes two ear canopies 26 and 27 that extend over respective ear frame structures 12 and 13.

Figure 6:
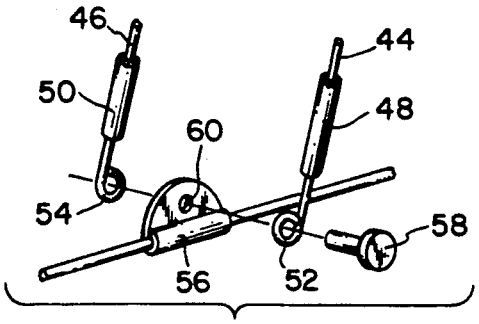
FIG. 6 is an enlarged exploded view of the pivotal attachment of the lower eyelets of a pair of frame segments to a respective according to the embodiment of FIG. 2.

Referring now to FIG. 2, there is shown in a cutaway view, an embodiment of the general frame structure of ear member 12 as well as the characteristic frame structure of an umbrella. It is to be understood that the embodiment of the frame structure of ear member 13 is identical to that of ear 12 only mirrored (see FIG. 8). Radially surrounding shaft 14 and axially slidable thereon is a runner 28 onto which are pivotally connected in a radially spaced apart manner, a plurality of outwardly extending struts (of which only one complete strut 30 is shown) that correspond in number to ribs 22. Struts 30 pivot upwardly and downwardly about runner 28 in like fashion to ribs 22, but in response to the sliding movement of runner 28 along shaft 14. Each strut 30 is pivotally connected to a respective rib 22 distal runner 28 via a strut joiner 32. Each strut joiner 32 is fixedly attached at a predetermined point to a respective rib 22 to provide the maximum size of the outstretched umbrella frame when fully extended. Thus, as runner 28 is upwardly pushed, struts 30 pivot about runner 28 to segment 36 of FIG. 4, but for nonduplication of description, only one ear frame structure 12 is shown. Each segment 44 and 46 has a respective stiffening member or tubular sleeve 48 and 50 radially surrounding the segment. As better shown in FIG. 6, the lower ends of segments 44 and 46 form respective eyelets 52 and 54. Eyelets 52 and 54 are pivotally attached to an attachment member 56 by a rivet 58 which extends through eyelets 52 and 54, and an aperture 60 in attachment member 56 such that eyelets 52 and 54 are respectively disposed on either side of aperture 60. Attachment member 56 is fixedly crimped on strut 30 approximately in the middle of strut 30. Thus, while member 56 is not moveable on strut 30, frame segments 44 and 46 are pivotable about rivet 58.

Figure 5:
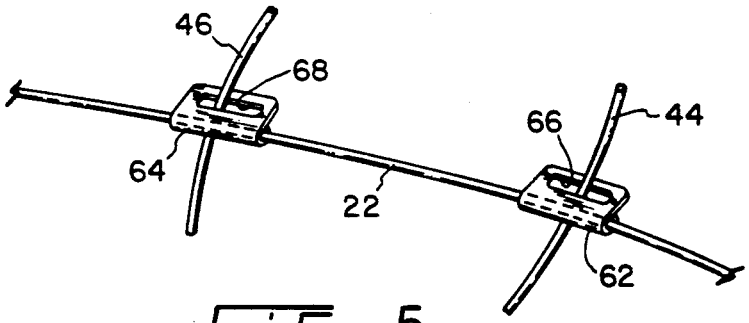
FIG. 5 is an enlarged partial view showing the guide brackets fixedly attached to a rib with one pair of the frame segments of the loop frame structure extending therethrough according to the embodiment of FIG. 2.

With particular reference to FIG. 5, fixedly crimped on a respective rib 22 are two guide brackets 62 and 64 each having a respective longitudinally extending slot 66 and 68. Frame segments 44 and 46 extend through respective slots 66 and 68 such that segments 44 and 46 are freely slidable along the longitudinal length of slots 66 and 68 and perpendicular thereto. Guide brackets 62 and 64 are disposed between crown 18 and joiner 32, the distance between guide bracket pairs 62 and 64 determining the eventual size of the ear loops.

Figure 7:
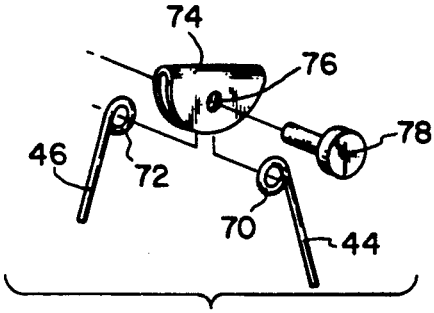
FIG. 7 is an enlarged exploded view of the swivel coupling pivotally connecting the upper eyelets of one pair of the frame segments.

Frame segments 44 and 46 project outwardly beyond rib 22 to form a loop shape that defines an ear as the umbrella frame is extended. Referring to FIG. 7, segments 44 and 46 have respective upper eyelets 70 and 72 integrally formed at their ends. A saddle-shaped swivel coupling 74 having an aperture 76 therethrough, receives upper eyelets 70 and 72 and a rivet 78. Thus, frame segments 44 and 46, as well as swivel coupling 74, are pivotable about rivet 78.

Figure 8:
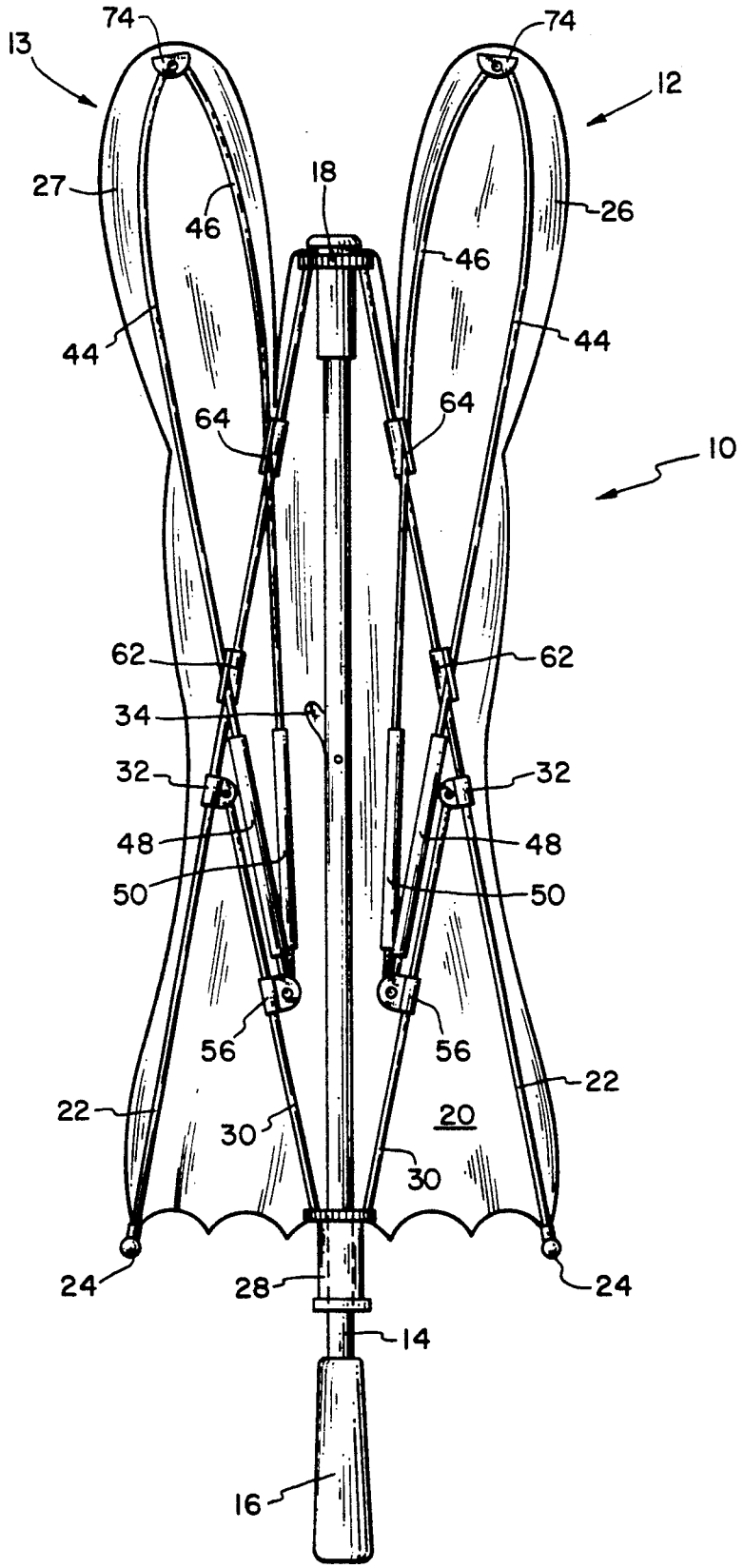
FIG. 8 is a front cutaway view of the umbrella according to the embodiment of FIG. 2 in a folded position.

FIG. 8 shows umbrella 10 in a folded position with the outer canopy 20 removed from the front of the umbrella. Since there was only one ear frame structure 12 described hereinabove, the other ear frame structure shown in FIG. 8 has corresponding numbers. Ear frame structures 12 and 13 are located on associated struts and ribs which are preferably diametrically opposed. Thus, the front sides of ear frame structures 12 and 13 face in the same direction.

It can be seen that the embodiment of the present invention folds compactly against handle 14 when runner 28 is in its fully downward position.

Figure 10:
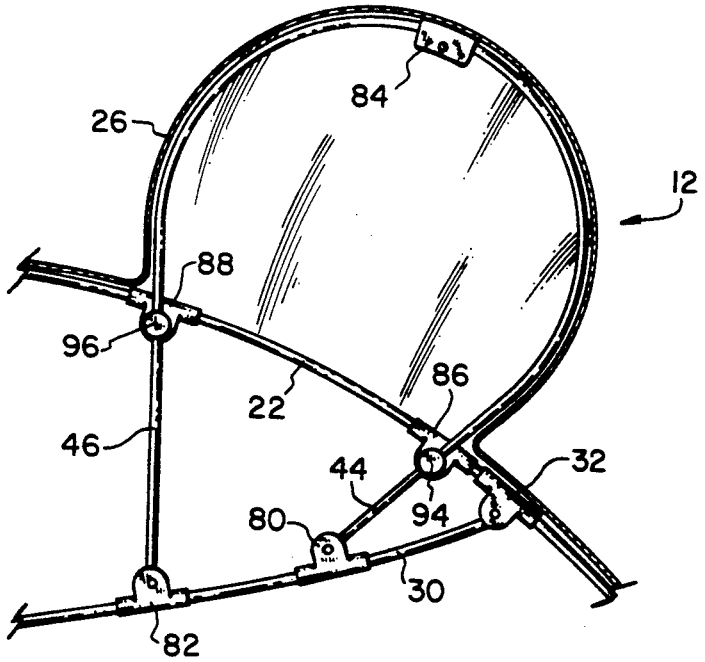
FIG. 10 is an enlarged front cutaway view of the frame structure of the ear of FIG. 9.
Figure 9:
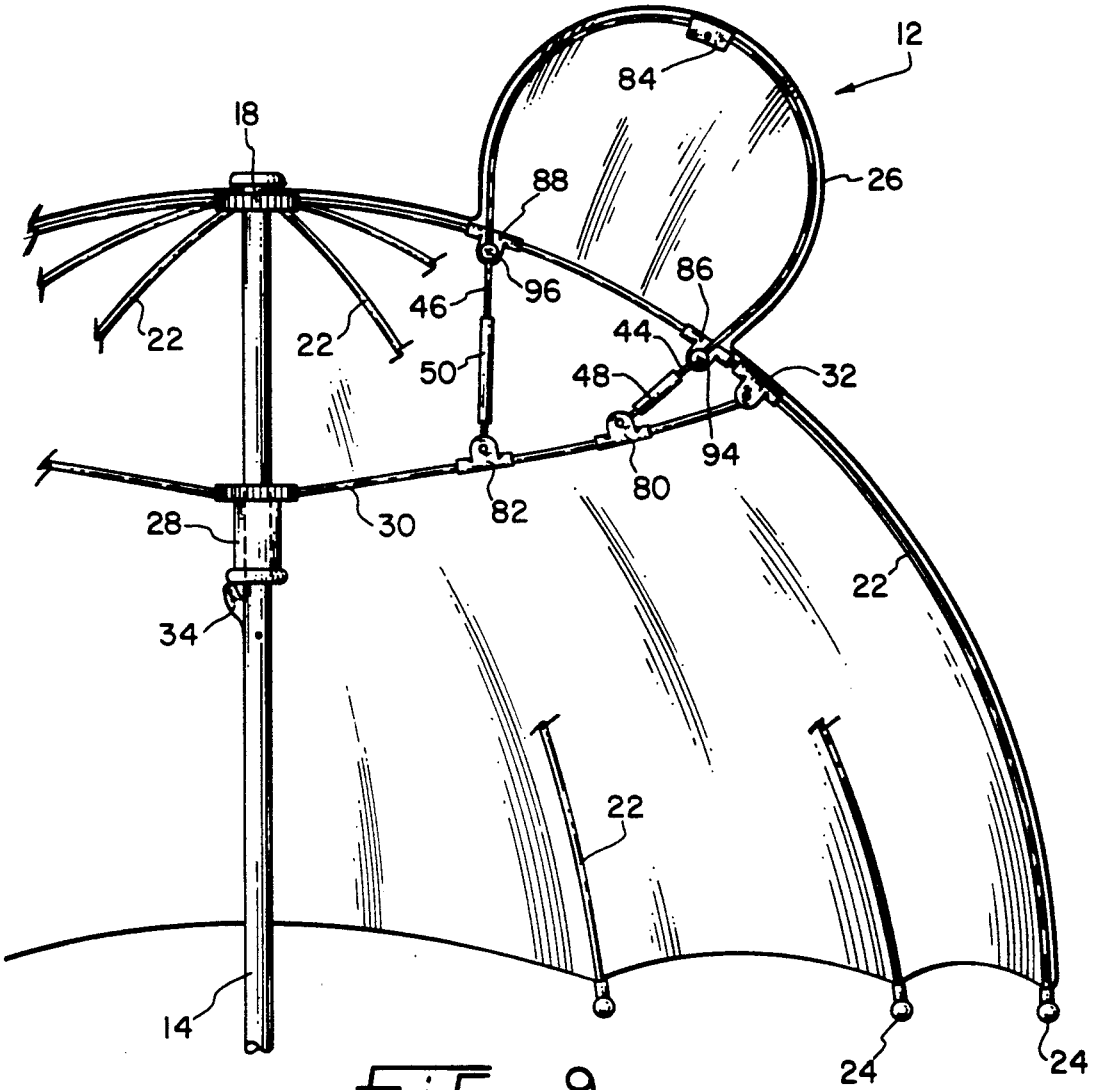
FIG. 9 is an enlarged fragmentary front cutaway view of the present umbrella showing the frame structure of one ear according to an alternative embodiment thereof.

Referring now to FIGS. 9 and 10, there is shown an alternative embodiment of the ear frame structure 12. Frame segments 44 and 46 are pivotally attached to separate connectors 80 and 82 which are fixedly crimped onto strut 30. Connectors 80 and 82 are spaced apart on strut 30 with connector 82 preferably disposed approximately midway on strut 30, while connector 80 is located between connector 82 and strut joiner 32. The ends of segments 44 and 46 distal connectors 80 and 82 are pivotally joined by coupling member 84 which is similar in form and function to swivel coupling 74 of FIGS. 2 and 3. FIG. 9 shows stiffening devices 48 and 50 respectively disposed on frame segments 44 and 46, while segments 44 and 46 are shown in FIG. 10 as lacking the stiffening devices described hereinabove in connection with the embodiment of the ear frame structure as shown in FIGS. 2 and 3. It is preferable to use the stiffening devices in order to prevent kinking of frame segments 44 and 46 and to further guide the segments as the umbrella is extended, although they are not essential.

Figure 11:
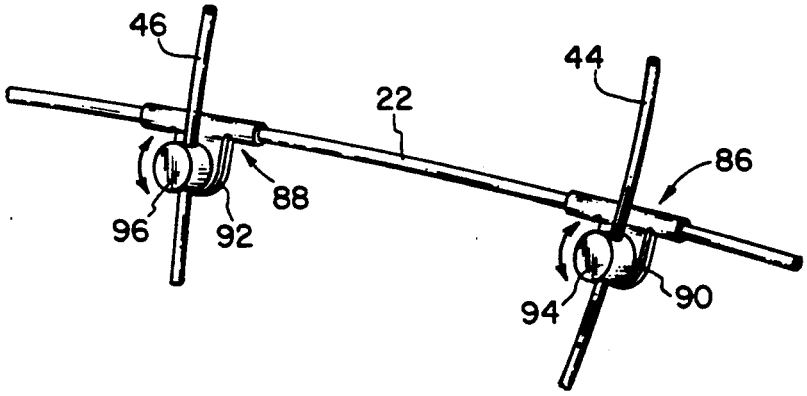
FIG. 11 an enlarged partial view showing the rotatable guide brackets fixedly attached to a rib with one pair of the frame segments of the loop frame structure extending therethrough according to the alternative embodiment of FIG. 9.

Additionally referring to FIG. 11, each segment 44 and 46 passes through a respective swivel guide 86 and 88 which are crimped onto a respective rib 22 in a like manne to guides 62 and 64 of FIG. 3. Swivel guides 86 and 88 each includes a flange portion 90 and 92 which has a disc-like member 94 and 96 pivotally attached thereto through which extend respective frame segments 44 and 46. Segments 44 and 46 are slidable through members 94 and 96. The disc-like members 94 and 96 respectively rotate in either direction about their axes relative to flange portions 90 and 92 as indicated by the arrows. Thus, as segments 44 and 46 pivot about respective connectors 80 and 82, disc-like members 94 and 96 rotate therewith to help form the ear-like projections.

It should be noted that the features of the ear structures shown in the various embodiments may be utilized in different combinations, as they are contemplated to be within the scope of this invention. Also, it is possible that one frame segment may be connected to a runner 28 while the other frame segment would be connected to a strut 30 by a segment attachment member (56) or a connector (80) as described hereinabove.

The umbrella and its frame structure operates as follows. First, it should be understood that the operation of struts 30, and ribs 22, shown with reference to the ear frame structures, also pertains to the operation of the plurality of struts and ribs which define the characteristic umbrella frame. Hereinafter, however, only struts 30, and ribs 22, which work in conjunction with the ear frames 12, 13 will be described and shown with reference to the figures.

As runner 28 is slid upwardly towards catch 34, struts 30 outwardly pivot about runner 28 which causes ribs 22 to be outwardly pushed, pivoting about crown 18, while struts 30 pivot about joiners 32. Contemporaneously, frame segments 44 and 46 are upwardly and outwardly extended through guide brackets 62 and 64 or swivel guides 86 and 88. The segments are confined from spreading too far apart by the limits of respective longitudinal slots 66 and 68 of guide brackets 62 and 64 in the case of the embodiment of FIGS. 2, 3, and 8. In the case of swivel guides 86 and 88, the ear segments extend through while at the same time rotate the guides. Ear canopies 26 and 27 which form a part of main canopy 20 help define the bowing of the loop structures by restraining the couplings from upward movement. Swivel couplings 74 or coupling members 84 are limited to and restrained from extending more than a predetermined distance by the size of the ear canopies 26 and 27. As the segments are upwardly stretched, the swivel couplings or coupling members 84 are restricted by the ear canopies, so the segments must therefore bend and pivot about the couplings. The tubular sleeves of one embodiment surrounding the bottom $\frac{1}{3}$ portion of the frame segments prevents the segments from bending or kinking along the tubular sleeve portion thereby limiting the bending to that portion of the brace which projects beyond the dome of the umbrella defined by the ribs. Thus, the simple structure defines loop shaped ear-like projections when the umbrella frame is opened, but which effectively collapses to an almost flat stick-like configuration when closed.

Although the structures according to the present invention have been described as defining ears, it is contemplated and envisioned that the structures and/or principles shown herein can define other projecting shapes. Such shapes may be symmetrically disposed, as herein described, or may be asymmetrical, or constitute only a single projection.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A collapsible umbrella frame comprising:
- a shaft with a handle portion on one end thereof;
- a crown disposed distal said handle portion;
- a plurality of ribs radially spaced about said crown and extending from said crown, said ribs defining an outer contour of the umbrella;
- a runner axially movable on said shaft;
- a plurality of struts radially spaced about said runner and corresponding in number to said plurality of ribs, said struts connected on one end to said runner and connected on another end to a corresponding rib; and
- a loop-shaped frame defining a collapsible projection extending outwardly beyond said ribs, said loop-shaped frame connected and anchored on one end to a strut of said plurality of struts;
- whereby as said struts are extended by upward movement of said runner, said loop-shaped frame bows to form a loop-shaped projection.

2. The umbrella of claim 1 comprising two loop-shaped frames connected and anchored on one end to a respective strut of said plurality of struts.

3. The umbrella frame of claim 2, wherein said respective struts are diametrically opposed struts.

4. The umbrella frame of claim 2, wherein said one end of each said loop-shaped frame is connected intermediate opposite ends of said respective strut.

5. The umbrella frame of claim 1, wherein said loop-shaped frame comprises two segments each having another end connected together.

6. The umbrella frame of claim 5, wherein said another ends are pivotally connected together.

7. The umbrella frame of claim 5, wherein said segments include eyelets integrally formed at said one end for pivotally connecting said segments to said strut.

8. The umbrella frame of claim 5, wherein said end of one of said segments is connected approximately intermediate opposite ends of said respective strut, and said one end of another of said segments is connected between said intermediate connection and an associated rib.

9. The umbrella frame of claim 1, further comprising a pair of guides for said loop-shaped frame, said pair of guides attached to and spaced apart on an associated rib, whereby said segments slidably extend through a respective said guide.

10. The umbrella frame of claim 1, wherein said one end of said loop-shaped frame is pivotally connected intermediate opposite ends of said strut.

11. The umbrella frame of claim 10, wherein said stiffening means is a tubular sleeve.

12. The umbrella frame of claim 1, further comprising means for stiffening said loop-shaped frame, said stiffening means being positioned between said strut and said rib.

13. A collapsible umbrella frame comprising:
- a shaft with a handle portion on one end thereof;
- a crown disposed distal said handle portion;
- a plurality of ribs radially spaced about said crown and pivotally extending from said crown, said ribs defining an outer contour of the umbrella;

a runner axially movable on said shaft;

a plurality of struts radially spaced about said runner and corresponding in number to said plurality of ribs, said struts connected on one end to said runner and connected on another end to a corresponding rib; and a loop-shaped frame defining a collapsible projection extending outwardly beyond said ribs, said loop-shaped frame connected and anchored on one end to a strut, said loop-shaped frame comprising two segments being connected and forming a continuous loop;

whereby as said struts are extended by upward movement of said runner, said loop-shaped frame bows to form a loop-shaped projection.

14. The umbrella frame of claim 13 comprising two loop-shaped frames connected and anchored on one end to a respective strut of said plurality of struts.

15. The umbrella frame of claim 14, wherein said respective struts are diametrically opposed struts.

16. The umbrella frame of claim 13, wherein said end of one of said segments is connected approximately intermediate opposite ends of said respective strut, and said one end of another of said segments is connected between said intermediate connection and an associated rib.

17. The umbrella frame of claim 13, wherein said segments include eyelets integrally formed at each end for pivotally connecting said braces to said struts and to each other.

18. The umbrella frame of claim 13, further comprising a pair of guides for said loop-shape frame, each said pair of guides attached to and spaced apart on an associated rib, whereby said segments slidably extend through a respective said guide.

19. The umbrella frame of claim 13, further comprising means for stiffening said loop-shaped frame, said stiffening means being positioned between said strut and said rib.

20. The umbrella frame of claim 19, wherein said stiffening means is a tubular sleeve.

21. A collapsible umbrella frame comprising:

a shaft with a handle portion on one end thereof;

a crown disposed distal said handle portion;

a plurality of ribs radially spaced about said crown and pivotally extending from said crown, said ribs defining an outer contour of the umbrella;

a runner axially movable on said shaft;

a plurality of struts radially spaced about said runner and corresponding in number to said plurality of ribs, said struts connected on one end to said runner and connected on another end to a corresponding rib;

two loop-shaped frames each defining a collapsible ear-like projection extending outwardly beyond said ribs, each said loop frame connected on one end to a respective strut of said plurality of struts; and a pair of spaced apart guides for each loop-shaped frame, each said pair of guides attached to an associated rib to guide said frames during expansion and contraction of the umbrella;

whereby as said respective struts are extended by upward movement of said runner, said frames bow to form loop-shaped projections.

22. The umbrella frame of claim 21, wherein said respective struts are diametrically opposed struts.

23. The umbrella frame of claim 21, wherein each loop-shaped frame comprises two segments each having another end connected together.

24. The umbrella frame of claim 23, wherein said end of one of said segments is connected approximately intermediate opposite ends of said respective strut, and said one end of another of said segments is connected between said intermediate connection and an associated rib.

25. The umbrella frame of claim 23, wherein said another ends are pivotally connected together.

26. The umbrella frame of claim 23, wherein each segment extends through a respective said guide.

27. The umbrella frame of claim 21, wherein said one end of each said loop-shaped frame is connected intermediate said respective strut.

28. The umbrella frame of claim 21, wherein said one end of each said loop-shaped frame is pivotally connected intermediate said respective strut.

29. The umbrella frame of claim 21, further comprising means for stiffening said loop-shaped frames, said stiffening means being positioned between said struts and said ribs.

30. The umbrella frame of claim 29, wherein said stiffening means is a tubular sleeve.

* * * * *